United States Patent [19]

Gaucher et al.

[11] 4,263,060

[45] Apr. 21, 1981

[54] METHOD FOR TREATING PARTS MADE OF TITANIUM OR TITANIUM ALLOY, AND PARTS PRODUCED THEREBY

[75] Inventors: Antoine Gaucher; Bernard Zabinski, both of Saint-Etienne, France

[73] Assignee: Centre Stephanois de Recherches Mecanique Hydromecanique et Frottement, Andrezieux-Boutheon, France

[21] Appl. No.: 5,160

[22] Filed: Jan. 22, 1979

Related U.S. Application Data

[63] Continuation of Ser. No. 495,773, Aug. 8, 1974, abandoned.

[30] Foreign Application Priority Data

Nov. 9, 1973 [FR] France ..... 73 40795
Jun. 27, 1974 [FR] France ..... 74 23069

[51] Int. Cl.[3] ..... C23F 7/06
[52] U.S. Cl. ..... 148/6.3; 148/133; 148/31.5

[58] Field of Search ..... 148/6.3, 11.5 F, 32, 148/133, 31.5; 427/295

[56] References Cited

U.S. PATENT DOCUMENTS

| | | | |
|---|---|---|---|
| 2,812,273 | 11/1957 | Shilliday et al. | 148/6.3 |
| 2,943,031 | 6/1960 | Warner | 148/6.3 |
| 3,096,272 | 7/1963 | Beer | 148/6.3 |
| 3,322,577 | 6/1967 | Smith, Jr. | 148/6.3 |
| 3,472,704 | 10/1969 | Watson et al. | 308/241 |
| 3,779,816 | 12/1973 | Mao | 148/6.3 |

*Primary Examiner*—Ralph S. Kendall
*Attorney, Agent, or Firm*—Irving M. Weiner; Pamela S. Burt; John L. Shortley

[57] ABSTRACT

A method of treating a part which contains titanium in its outer surface including the steps of removing a portion of the natural oxide layer, placing the part in an enclosure, evacuating the enclosure, isolating the evacuated enclosure, and introducing oxygen in an amount ranging from $10^{-3}$ to 2.55 milligrams for each square centimeter of total outer part surface area, and heating to a temperature from 450° C. to 880° C.

18 Claims, 3 Drawing Figures

METHOD FOR TREATING PARTS MADE OF TITANIUM OR TITANIUM ALLOY, AND PARTS PRODUCED THEREBY

CROSS-REFERENCE TO RELATED APPLICATIONS

This application is a continuation of U.S. patent application Ser. No. 495,773, filed Aug. 8, 1974, now abandoned, and claims priority from French patent application Nos. 73 40 795 and 74 23 069, filed Nov. 9, 1973, and June 27, 1974, respectively.

The present invention relates generally to a method of treating a part which contains titanium in its external surface. In particular, the present invention relates to a new method for the treatment of mechanical parts, the outer surfaces of which contain titanium. Such parts may be made of solid titanium, made of titanium alloys, or made of any material, and surface-coated with titanium or titanium alloy.

BACKGROUND OF THE INVENTION

It is known that titanium is a metal which has advantageous features. In particular, it is light, substantially insensitive to corrosion, and has good mechanical properties. On the other hand, titanium has a serious drawback, in that it has very poor friction properties, and seizes when it is made to rub on itself or on another material, such as, for instance, steel.

Because titanium is essential to advanced industries, such as those dealing with space travel, many considerable efforts have been made to give it a good frictional strength at all costs.

Promising results have been obtained, in particular, through oxidation. As a matter of fact, it has been found that by coating titanium or titanium alloy parts with a coat of an oxide, most of the time based on $TiO_2$, some frictional strength was obtained. To form said coat of oxide, various means have been used, such as anodic oxidation, heating under an oxidizing atmosphere in an enclosure, or the like. However, the results obtained were never completely satisfactory, due to either the coat flaking off during the friction, or scale being generated on the surfaces of the parts.

Some workers have tried to obviate such drawbacks by carrying out the treatment in a number of steps, for instance, by producing a layer of scale on the surface of the part to be treated through an oxidation in the oxygen, and then heating the coated part in argon in order that said coat of scale may become diffused within the titanium part. But such a method, which is difficult to work out on an industrial scale, has a further drawback in that it requires high treating temperatures, on the order of about 900° C., which is much higher than the temperature generally accepted for annealing titanium, and long treatment time exceeding 24 hours.

In the area of surface treatments, there are many known methods applicable to many types of materials. The principal technologies known to applicants are electrolytic processes, and low-pressure treatments in alkaline baths or gaseous atmospheres. Each of these technologies presents advantages and disadvantages, either during processing or in obtaining essential parameters required for obtaining the desired surface layers. Some methods require high temperatures which are not compatible with the materials to be treated. For instance, aluminum alloys are damaged by high temperature treatment, and wear resistance of titanium alloys is decreased by the modification of its physical structure by exposure to high temperatures. Electrolytic methods require extremely precise surface preparation to obtain perfectly adherent layers, which are absolutely necessary for all mechanical parts submitted to frictional forces. Also, electrolytic processes produce thin $TiO_2$ layers.

Among the prior art known to applicants are U.S. Pat. Nos. 3,322,577, and 3,779,816. U.S. Pat. No. 3,332,577, issued in 1967 to Smith, entitled "METHOD AND APPARATUS FOR THE CONTINUOUS PRODUCTION OF OXIDE COATINGS" relates to a low pressure treatment of aluminum to produce a single surface layer of $Al_2O_3$ as a dielectric film in an electrolytic capacitor, or to a similar single layer from tantalum for the same purpose. Electron bombardment heating is used to limit the film thickness.

A single component layer is not suitable for a titanium friction surface.

U.S. Pat. No. 3,779,816, issued in 1973 to Mao, entitled "METHOD OF MAKING MOLD FOR FORMING OBJECTS" relates to the formation of a $T_iO_2$ (rutile) layer as a release agent for battery grid molds, by a constant flow, low pressure process.

As is known, $T_iO_2$ is very weak, especially in thin layers, and unsuitable for frictional surfaces.

The present invention provides a method adapted to be used commerically for oxidizing titanium and the alloys thereof, which avoids all the above drawbacks and gives extraordinarily good results, such as have never been obtained up to now in the field of resistance to seizing and wear.

SUMMARY OF THE INVENTION

The present invention provides a method of treating a part which contains titanium in its external surface, and includes the steps of removing at least a portion of a natural layer of oxide which covers the part, and placing the part within a fluid-tight enclosure. The enclosure is then evacuated until the pressure therein ranges from about 1 to about $10^{-8}$ Torr. Then the enclosure is isolated from the evacuating means. Oxygen is then introduced into the evacuated fluid-tight enclosure in an amount ranging from about $10^{-3}$ to about 2.55 milligrams per each square centimeter of total external surface area of the part or parts within the evacuated fluid-tight enclosure. The enclosure is heated to a temperature ranging from about 450° C. to about 880° C.

The present invention also provides a product obtained by treating a part in accordance with the aforementioned method.

The principal object of the invention is to produce a friction surface on a titanium or titanium alloy part, or a part coated with titanium or titanium alloy, by forming a surface layer of a number of titanium oxides, in gradually decreasing ratios of oxygen to titanium, having only a very thin outmost surface of $T_iO_2$, and oxides such as $Ti_{10}O_{19}$, $Ti_8O_{15}$, $Ti_7O_{13}$, $Ti_4O_7$, $Ti_3O_4$, $Ti_2O$, TiO between the $T_iO_2$ outer surface and the Ti part material, by precisely controlling the amount of oxygen available in a low pressure gaseous atmosphere and the treatment temperature and time.

It is a further object to form a friction surface composed of titanium oxides in an economical simple manner.

The treatment will be in conformity with the invention if it meets the following requirements jointly:

(1) the natural layer of oxide which covers any part, the outer surface of which contains titanium, must be removed, at least partially; in any case, the thickness removed should be greater than 2 microns;

(2) the parts to be treated are put in a fluid-tight furnace in which the pressure has been lowered to a value ranging from 1 to $10^{-8}$ Torr, before introducing an amount Q of oxygen strictly defined as a function of the total area S of the parts to be treated. If Q is expressed in milligrams and S is expressed in square centimeters, then the ratio Q/S according to which the treatment according to the invention is carried out will range from $10^{-3}$ to 2.55 milligrams per square centimeter; and (3) the temperature of treatment ranges from 450° C. to 880° C.

According to another feature of the invention, the sequence of operations is as follows:

(a) the natural layer of oxide which coats the parts to be treated is partially removed;

(b) the parts are disposed in an enclosure connected to the vacuum system;

(c) a vacuum is created in said enclosure such that the pressure therein ranges from 1 to $10^{-8}$ Torr;

(d) the enclosure is isolated from the vacuum system;

(e) an amount of oxygen defined as a function of the total outer area of the parts to be treated contained in the enclosure is introduced into the latter; and (f) the enclosure containing the parts is heated to a predetermined temperature ranging from 450° C. to 880° C.

According to another feature of the invention, the creation of vacuum is carried out at any time after the temperature of the enclosure is brought to a temperature higher than the ambient temperature, in which case the sequence of operations becomes:

(a) removal, at least partially, of the natural layer of oxide, (b) disposing the parts inside the enclosure, (c) starting the heating system, (d) creating a vacuum, and then isolating the enclosure (e) introducing the oxygen.

According to another feature of the invention, the oxygen required for the treatment may be supplied by any means whatever, such as, by way of non-limiting examples, as a gas directly injected into the enclosure;

through the agency of a substance capable of releasing oxygen under the action of the temperature; said substance may be, for instance, an oxide;

by degassing a body which has previously adsorbed some oxygen.

According to another feature of the invention, the oxygen is not introduced as a whole at the beginning of the treatment, but is introduced during the whole period of treatment, either continuously or batchwise, after the vacuum is created in the enclosure.

According to another feature of the invention, the cooling of the parts takes place slowly inside the enclosure, that is, by merely stopping the heating of the enclosure.

According to another feature of the invention, the parts are cooled suddenly, either inside or outside the enclosure.

A part according to the invention, the outer surface of which contains titanium initially, is characterized in that after being treated it is coated with a surface layer consisting mainly of a plurality of titanium oxides, in a predetermined order and having a thickness greater than 10 microns.

The amount of oxygen duly determined as a function of the total area of the parts to be treated may be the only gas present in the enclosure during the treatment. But if filler gas is desired, a rare or inert gas should be preferably chosen, argon being particularly suitable. It is advantageous to calculate the amount of said filler gas so that, after expansion, the gas pressure inside the enclosure will be substantially equal to the atmospheric pressure.

The treatment remains likewise within the scope of the invention if, during the operation, there would be a variation of the ratio Q/S in course of time, provided that the values reached by said ratio pass through the claimed area of the peak of curve C during the period of treatment.

According to another feature of the invention, the temperature and the time of treatment of a part are determined from a diagram the coordinates of which are the times of treatment, on the one hand, and the temperatures of treatment, on the other hand, so as to correspond to a point lying inside a hatched area included between two limit curves which define the requirements to be met to obtain a surface layer with a thickness sufficient for enabling the titanium so treated to rub without seizing.

The layer produced by the treatment according to the invention has original and outstanding properties:

(1) the adhesion of said layer to the support is quite outstanding, as a result of the original morphology of the "hitching" area, where there is no break of continuity. Passing from an area consisting mainly of $TiO_2$ to a lower layer consisting mainly of titanium takes place with an even gradient, due to an inter-diffusion between the two bodies.

(2) In contradistinction with all the other known layers of oxide, no residual tensile stress appears, which imparts to the treatment according to the invention the advantageous property of affecting only very slightly the resistance of the parts to strains. This property results from the fact that the total hardness of the layer has a minimum value at the peak of curve C.

(3) But the most astounding fact is that the friction coefficient can go down to the very low value of 0.07 on steel parts, without the use of any lubricant.

(4) The sensitivity of titanium to seizing, which is so much feared in the mechanical industry, has disappeared, even under very difficult load conditions.

The appended drawing, given by way of non-limiting example, will allow a better understanding of the features of the invention.

DETAILED DESCRIPTION

Figure 1:
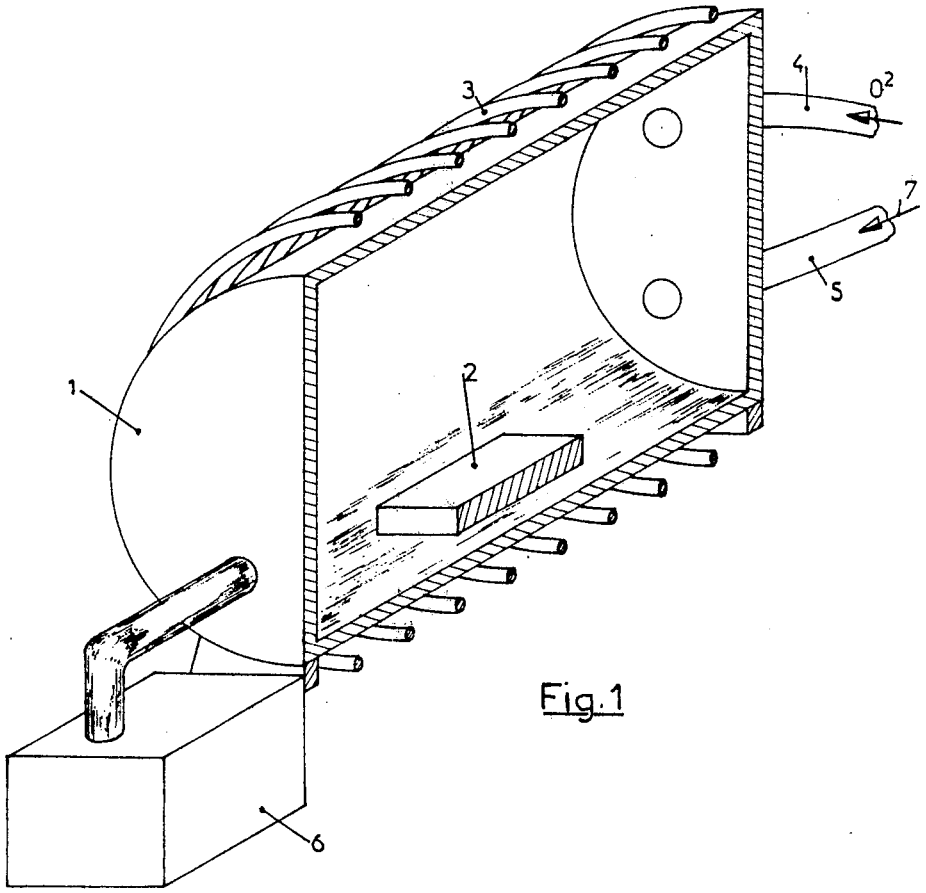
FIG. 1 is a sectional view giving a diagrammatic representation of an example of an enclosure for carrying the method into practice.

With reference to FIG. 1, a part 2 to be treated is disposed inside an enclosure 1. The part 2 may be of solid titanium, or of titanium alloy, or else covered with titanium or a titanium alloy.

Figure 3:
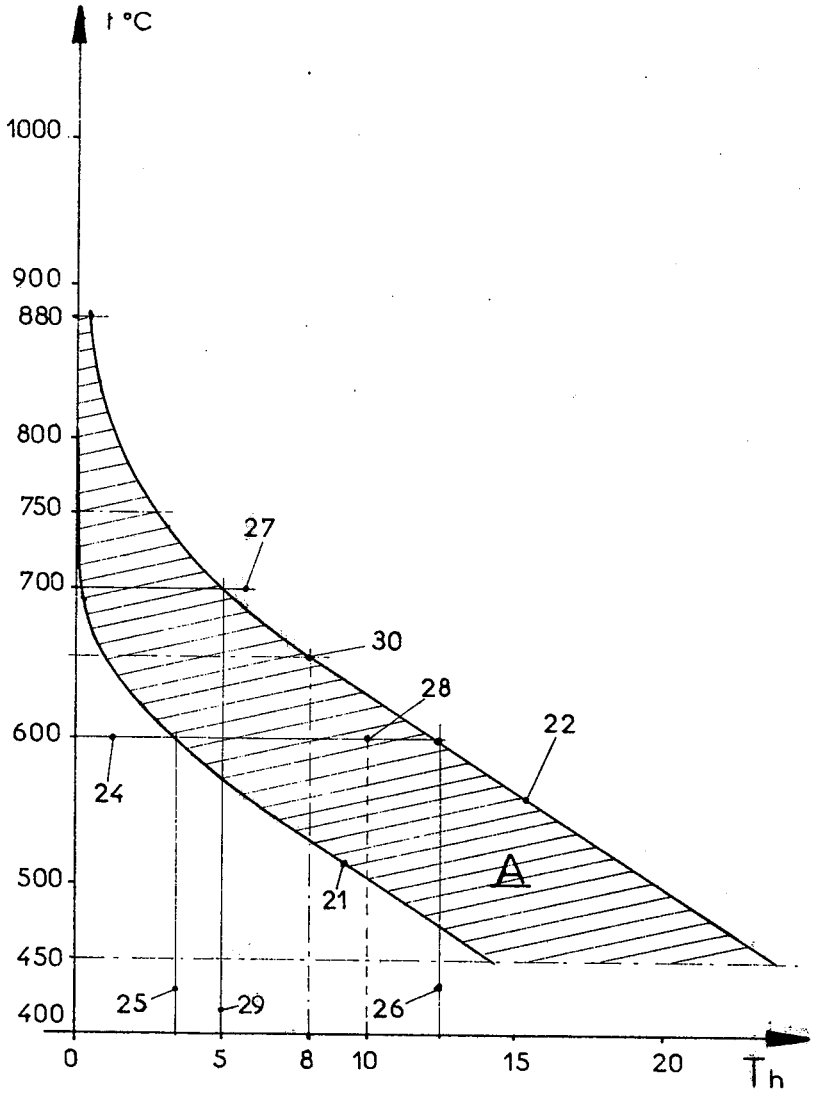
FIG. 3 is a diagram which indicates the time of treatment as a function of the temperature, so as to obtain a non-pulverous, sufficiently thick layer which is able to be rubbed without seizing.

The enclosure 1 is provided with heating means, such as electric heating resistors 3, which allow varying the temperature inside the enclosure 1 with accuracy as the method is being carried out, in accordance with the time-temperature envelope shown in FIG. 3.

A vacuum system or evacuating means 6, such as a pump or the like, is connected to the inner space of the enclosure 1.

Figure 2:
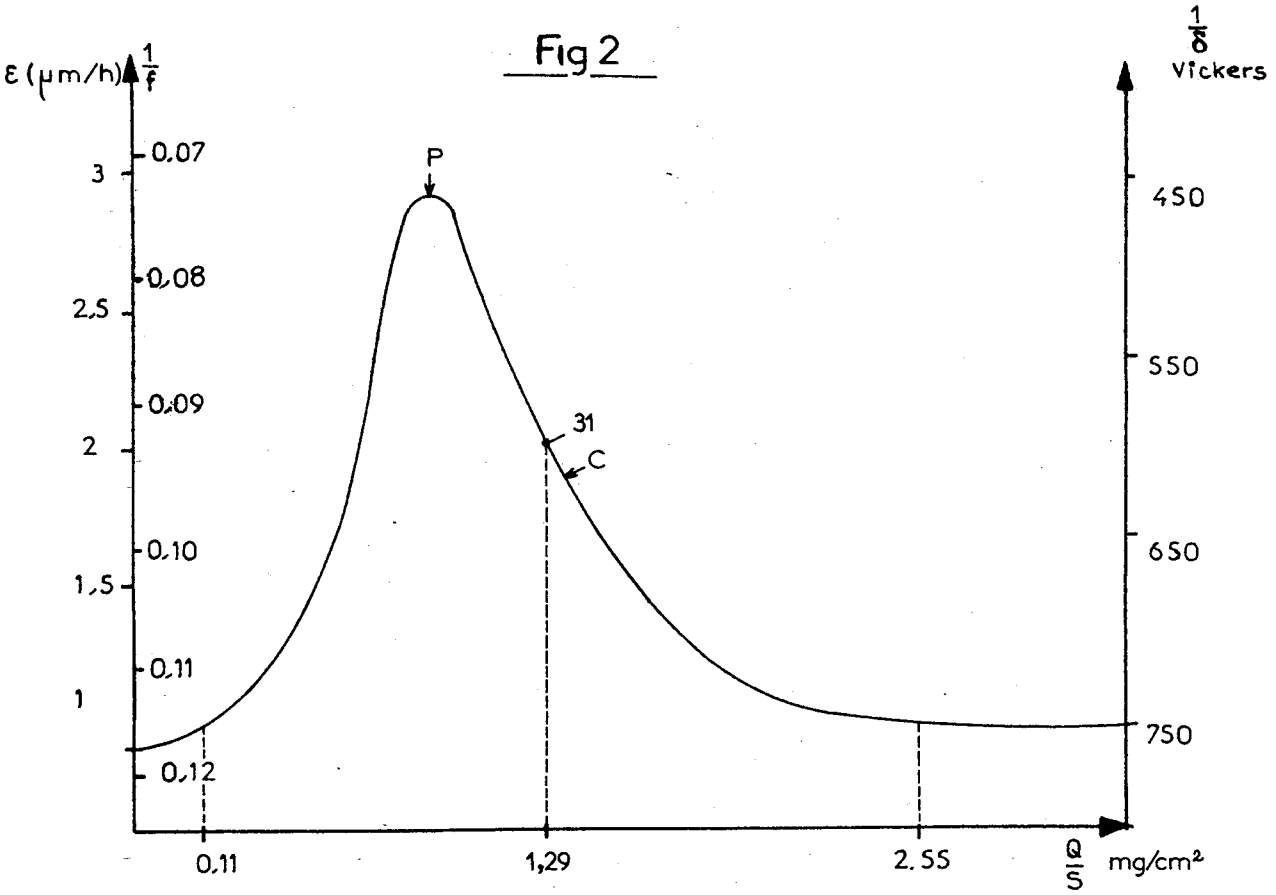
FIG. 2 is a graph showing the law of variation of the thickness $\epsilon$ of the layer, of the friction coefficient f, and of the total hardness $\delta$, as a function of the amount of oxygen introduced per unit area, the curves $\epsilon$, f and $\delta$ merging in a single curve C.

A line 4 is provided for the supply of oxygen, in accordance with FIG. 2, while a line 5 is provided for supplying an inert gas, such as argon, in the direction of the arrow 7.

After the treatment is completed, there is found that the surface of the part 2 is covered with a layer consisting mainly of titanium oxides, the characteristics of which are illustrated in the graph of FIG. 2, which is given by way of non-limiting example.

According to the preferred embodiment of the invention, the desired frictional surface is realized in the following manner:

(1) Removing at least part of the natural $T_iO_2$ corrosion layer on the surface of a part.
(2) Calculating the surface area of the part.
(3) Calculating a precise charge of oxygen based on the surface area according to FIG. 2, with a ratio of oxygen weight to surface area depending on desired characteristics.
(4) Placing the part in an evacuated heating chamber.
(5) Injecting the calculated oxygen charge, and an inert filler gas to equalize chamber pressure, if desired.
(6) Maintaining the part in the chamber for a time in proportion to chamber temperature within the limits shown in FIG. 3.

Because a fixed, calculated amount of oxygen is injected into the chamber at the start of the process, the partial pressure of the available oxygen progressively decreases as oxygen is absorbed by the surface of the part. Because the amount of oxygen available is decreasing, the amount of oxygen in the titanium oxides decreases as the oxygen penetrates deeper during the process.

Therefore, the oxide layer formed is composed of a great number of titanium oxides, with the ratio of oxygen to titanium decreasing in a continuous manner from external to internal. The external layer is $TiO_2$ (rutile) less than 1 micrometer thick, so that it is not pulverulent. Then in non-exclusive order, a thick layer (more than 10 micrometers thick) of oxides such as $Ti_{10}O_{19}$, $Ti_{18}O_{15}$, $Ti_7O_{13}$; $Ti_4O_7$; $Ti_3O_4$, $Ti_2O$, and TiO are presented between the $TiO_2$ surface and the Ti part. Due to the lack of abrupt changes in composition, the layer is strong, and the layer has been found to have unanticipated resistance to seizure and abrasion as a friction surface.

The originality of this new oxidation treatment is based on the following scientific discovery:

A test piece made of titanium and having an area S was heated under conditions of temperature, time, pressure, ambience, and the like, which will be made precise hereinafter—in a fluid-tight furnace into which a weight Q of oxygen was introduced. A layer formed on the surface of the test piece consisted mainly of titanium oxides.

The experiment was repeated a number of times, while varying the ratio Q/S of the weight of oxygen introduced to the part or parts treated.

For all the parts treated in this way, the total hardness $\delta$, the thickness $\epsilon$ of the layers formed within the time unit, and the friction coefficient f of the test piece thus treated when the latter rubs on steel, were carefully measured for each experiment.

If the ratio Q/S is plotted as abscissa and the values $\delta$, $\epsilon$, and f are plotted as ordinate on a system of axes suitably selected (FIG. 2), it will be seen that the three curves obtained merge in single curve C (FIG. 2), the peculiarity of which lies in the fact that it presents a very high peak and a very narrow base. This scientific phenomenon, observed for the first time by applicant, leads very naturally to the oxidation treatment of titanium according to the present invention. It is a question of replacing, at least partially, the natural oxide layer $T_iO_2$, which coats any titanium part, by the oxide layer obtained when the oxidation takes place according to the peak of the curve C of FIG. 2.

The graph of FIG. 2 illustrates, as a function of the ratio Q/S, the variations of the friction coefficient f, the hardness $\delta$, expressed in Vickers units, and the thickness $\epsilon$ of the surface layer obtained after treating a part made of a titanium alloy. The figures vary with the nature of the basic part. But, if the method according to the invention is duly complied with, the relativity of said variation remains similar for any titanium-containing part, and the curves $\epsilon$, f and $\delta$ are merged in a curve C.

The graph of FIG. 3 illustrates, as area A bounded by curves 21 and 22, a range of treatment times and temperatures which has been experimentally found to result in desirable frictional surfaces, when a charge of oxygen as calculated in the manner that was used to construct FIG. 2 was used.

The originality of the results which the treatment according to the invention allows obtaining is illustrated by the performance figures reached, several examples of which are given hereinbelow in a non-limiting way.

"FAVILLE" TYPE TESTS

EXAMPLE 1

This type of test is carried out on a Faville-Levally apparatus, in which a cylinder of a diameter of 6.5 mm and a height of 40 mm, the surface S of which is equal to 9.35 $cm^2$, is rotated between two jaws cut as V's having 90° angles. A load, which increases linearly as a function of time, is applied on the jaws.

The test is carried out in the ambient air. A test part made of titanium or titanium alloy and conventially oxided, for instance, in a bath of sulfuric acid at environmental temperature with a current density of 0.3 amperes per square centimeter for 20 minutes, seizes practically instantaneously between the steel jaws.

In contrast, a test part treated by the method according to the invention, that is, having first been subjected to a sanding operation in order to remove the natural layer of oxide on a depth of 2.5 microns, and then heated to 650° C. for 8 hours (point 30, FIG. 3) in a furnace containing 12 mg of oxygen, so as to treat with a ratio Q/S equal to 1.29 (point 21, FIG. 2), the auxiliary gas being argon, can rub under a load of 600 daN without any seizing occurring. In this case the coefficient of friction throughout the test remains lower than 0.12.

EXAMPLE 2

Tests were carried out with test parts of the "Faville" type, treated under the same conditions as in the first example, but with an amount of oxygen equal to 32 mg. Under such conditions the initial ratio Q/S is equal to 3.42 mg/cm$^2$.

Now, because of leaks in the furnace, a ratio Q/S equal to 0.07 mg/cm$^2$ was reached at the end of the treatment, that is, after 8 hours at 650° C., which means that the curve C as shown in FIG. 2 is followed near the end of the treatment.

Thus, during the period of treatment, the continuously decreasing ratio Q/S passed through the area of the peak P of the curve C of FIG. 2.

With test parts treated in this way, results are obtained which are in conformity with the invention. Although the results are not as good as if said ratio Q/S had been kept between 0.11 and 2.55 milligrams per square centimeter during the whole duration of the treatment, they are, however, definitely better than the results obtained with the known methods. As a matter of fact, a load of 600 daN can be reached without any seizing, with a coefficient of friction equal to 0.15.

In other words, experimental results yielded the surprising conclusion that acceptable, although not optimum, results, may be obtained even if treatment parameters vary from the preferable values, either intentionally or accidentally. The critical factor in producing an adherent titanium oxide friction layer appears to be a constantly-decreasing quantity of available oxygen during treatment, at least where the constantly-decreasing amount becomes within preferred initial parameters during the treatment.

TEST ON A CYLINDRICAL FRICTION MACHINE WORKING ON A FLAT SURFACE

EXAMPLE 3

A ring made of titanium or titanium alloy, having a diameter of 35 mm and a height of 20 mm, and a speed of rotation of 1200 r.p.m., rubs on a steel plate in the shape of a parallelopiped, the dimensions of which are 30×18×8 mm. An increasing lead varying from 0 to 600 daN within 3 min. 20 sec. is applied to the plate.

After the maximal load of 600 daN is reached, the test is carried on at said maximum load. The test is effected in pure and neutral vaseline oil.

A ring of titanium or titanium alloy, treated by the conventional treatment of anodic oxidation mentioned hereinabove, seizes as soon as the load reached 80 daN. In contrast, a ring treated by the method according to the invention, as explained in Example 1 (650° C., 8 h; 1.29 mg/cm$^2$) may reach the load of 600 daN and rotate for 2 hours under said load without any trace of seizing appearing.

WEARING TEST

EXAMPLE 4

This type of test consists in causing a titanium or titanium alloy ring, having an outer diameter of 60 mm and a speed of rotation of 100 r.p.m., to rub on the hemispheric end of a ball made of 100° C. 6 steel, the radius of curvature of said end being equal to 6 mm. A constant load equal to 5 daN is applied to said ball.

An anodically-oxided ring was able to rotate only for two hours, while losing 12 mg every 30 minutes regularly, whereas with a test part treated according to the invention as previously described the results are better by a factor of 100, and it is possible to rotate for more than 10 hours. At the end of this latter period of time, only a minimum wear had occurred, which was only about 2.5 mg.

Here is an additional example of a treatment in accordance with the invention:

A part made from a UTA6V alloy of titanium containing 6% aluminum and 4% vanadium. The part was a test part of the "Faville" type, with a diameter of 6.5 cm, a height of 40 mm, and an area of 9.35 cm$^2$.

The part was sanded for 2 minutes in apparatus known under the trade name "Vapor Blast," with a jet pressure of 5 bars, and a particle size of the abrasive of 4 microns. Upon completion of the sanding operation, the part was quickly disposed inside a fluid-tight vacuum furnace of stainless steel, with a diameter of 104 mm, a length of 965 mm, and a volume equal to 8.275 cm$^3$.

Then, the vacuum system was started until the pressure in the furnace was between $10^{-5}$ and $10^{-6}$ Torr. The enclosure was isolated, and then the heating system was started till the part was brought to a temperature of 600° C. in the furnace.

During the temperature increase, an amount of oxygen equal to 16.8 mg (1.8 mg/cm$^2$ of area to be treated) was introduced. Then auxiliary argon was introduced until a total pressure of 400 Torr in the enclosure was obtained.

After keeping the parts for 10 hours at 600° C. in the enclosure (point 28, line 24, FIG. 3), the enclosure was allowed to cool down to about 100° C., and the part was removed.

The outermost layer obtained by the treatment was a layer consisting essentially of titanium oxide, $TiO_2$. The overall thickness was about 24 microns. Its average hardness was 500 Vickers under 15 grams.

When a test of the Faville type as described hereinabove is carried out, with jaws of carbon steel (SC 35) containing 0.35% of carbon, the following results were obtained:

At the start, a very low coefficient of friction on the order of 0.05 was observed. Then, as the load increased, the coefficient of friction increased slightly to stabilize itself at a value of 0.075. At the end of the test, that is, after 40 seconds of operation, it was noted that the test part creeps under a load of 540 daN.

After the test, the friction area was absolutely smooth, weighing the test part before and after the test showed that the wear was less than 1 mg, which may be considered as zero in practice. By way of comparison, a test carried out with an untreated test part leads to instantaneous seizing.

It will be noted that the method of procedure defined in the above example conforms strictly to the invention in that it comprises the four original features:

(1) the natural oxide layer which covers the part before the treatment is removed, by the sanding operation;
(2) an amount of oxygen Q which is such that the ratio Q/S ranges from 0.11 and 2.55 milligrams per square centimeter is introduced in the fluid-tight furnace;
(3) the process of oxidation occurs in the presence of the total amount of oxygen required and a rare gas, such as argon;
(4) the temperature ranges from 450° C. to 880° C.

But this example of a practical method of procedure is given only as a non-restrictive one, as any method of oxidation of titanium or titanium alloys which complies with the joint four features of the treatment according to the invention would be a method of procedure proceeding from the invention.

Thus, while complying with the determined limits for the amount of oxygen introduced, there is shown in FIG. 3 the area of treatment for titanium parts, which area is limited by the curves 21 and 22.

A first example is given by the parts treated at a temperature of 600° C. The line 24, which corresponds to said treating temperature and is plotted at the ordinate 600° C. on the diagram of FIG. 3, passes through the hatched area A according to a period of treating time bounded by the two lines 25 and 26, which correspond to treating times of 3½ hours and 12½ hours, respectively.

The part will therefore be treated within that range of time.

Keeping the part at 600° C. for more than 12½ hours would result in a pulverous layer, while keeping said part at 600° C. for less than 3½ hours would give a layer which would be too thin to allow rubbing correctly.

A second example is given for a part treated at a temperature of 700° C. The line 27, which corresponds to said treating temperature and is plotted at the ordinate 700° C. on the diagram of FIG. 3, passes through the hatched area A according to a period of treating time ranging from 15 minutes to 5 hours.

The part will thus be treated within that range of time to obtain the qualities defined hereinabove, with an amount of oxygen ranging from $10^{-3}$ to 2.55 mg/cm$^2$.

In another example, a part 2 to be treated is disposed inside the enclosure 1. A vacuum is created in the enclosure until the pressure in the latter is between 1 and $10^{-8}$ Torr. An amount of oxygen ranging from 0.1 cmc to 60 cmc per cm$^2$ of surface to be treated is introduced into the enclosure, and then the enclosure is heated to a temperature ranging from 450° C. to 880° C. After this treatment the part 2 is coated with a surface layer consisting essentially of titanium oxides and having a thickness greater than 15 microns.

Numerous variations and modifications of the invention may be made by one skilled in the art without departing from the spirit and scope of the appended claims.

We claim:

1. A method of treating a part which contains titanium in its exterior surface to improve the frictional properties and the resistance of such parts to wearing and seizing comprising the steps of:

removing at least a portion of a natural layer substantially of titanium dioxide which covers said part;

placing said part within a gas and fluid-tight enclosure;

evacuating said enclosure until the pressure therein is between about 1 Torr and $10^{-8}$ Torr;

isolating said enclosure from the evacuating means;

introducing a predetermined quantity of oxygen into said evacuated enclosure;

a first quantity of said oxygen within said enclosure ranging from about $10^{-3}$ to about 2.55 milligrams for each square centimeter of total external surface area of said part or parts within said evacuated enclosure at a point in time during said treatment; and heating said enclosure for a predetermined time to a predetermined temperature between about 450° C. to about 880° C.; and wherein the quantity of said oxygen within said evacuated enclosure substantially continuously decreases from said first quantity during said treatment, forming an oxide layer on the surface of said part, said oxide layer having a percentage of oxygen which substantially continuously decreases from an external surface of said layer to said surface of said part.

2. A method according to claim 1, wherein:

said entire predetermined quantity of oxygen is introduced into said evacuated enclosure substantially simultaneously.

3. A method according to claim 1, wherein:

said predetermined quantity of oxygen is introduced continuously during said heating step.

4. A method according to claim 1, wherein:

said predetermined quantity of oxygen is introduced in successive batches throughout the durations of said heating step.

5. A method according to claim 1, wherein:

said predetermined quantity of oxygen is brought into said enclosure by means of an oxygen-bearing compound which is capable of releasing oxygen under the action of said heating step.

6. A method according to claim 1, wherein:

said predetermined quantity of oxygen is brought into said enclosure by an oxygen-adsorbing compound.

7. A method according to claim 1, wherein:

during the treatment of said part, said first quantity of oxygen within said evacuated enclosure in relation to said total external surface area temporarily reaches a value ranging from 0.11 to 2.55 milligrams per centimeter squared and substantially continuously decreases thereafter.

8. A method according to claim 1, wherein:

prior to the step of evacuating said enclosure, said enclosure is heated to a temperature which is higher than ambient temperature.

9. A method according to claim 1, including:

the step of introducing an inert gas into said evacuated enclosures after said oxygen has been introduced into said chamber.

10. A method according to claim 1, wherein:

during the step of removal of said natural layer of oxide, a thickness of at least 2 microns of said oxide covering said part to be treated is removed.

11. A method according to claim 1, wherein:

the temperature and the time said temperature is applied for said heating step are determined from a diagram illustrated in FIG. 3 to correspond to a point lying inside a hatched area A included between two limiting curves 21 and 22 as shown in FIG. 3 which define the requirement to obtain a surface layer on the treated part which is non-pulverous and sufficiently thick to be capable of being rubbed without seizing.

12. A method according to claim 1, wherein:

said temperature ranges from about 500° C. to about 750° C.

13. A method according to claim 1, wherein:

the time during which said temperature is maintained ranges from two to thirty hours.

14. A method according to claim 1, including:

the step of cooling the part slowly inside said enclosure.

15. A method according to claim 1, including:

after said heating step, the step of cooling the part abruptly.

16. A product obtained by treating a part in accordance with the method set forth in claim 1.

17. A product according to claim 16, wherein:

after the treatment is completed, said part is covered with a layer of consisting essentially of a plurality of oxides of titanium and having a thickness greater than 10 microns.

18. A product according to claim 16, including:

a surface layer which is primarily made of titanium dioxide and which is connected to a lower layer consisting primarily of titanium through a zone of a plurality of oxides of titanium having an even gradient of transition.

* * * * *